US005598819A

United States Patent [19]

Blackburn

[11] Patent Number: 5,598,819

[45] Date of Patent: Feb. 4, 1997

[54] PISTON ENGINE CYCLES

[76] Inventor: Anthony E. Blackburn, 1 Lord Seftpn Way, Liverpool, Merseyside, United Kingdom, L37 5AA

[21] Appl. No.: 108,692

[22] PCT Filed: Dec. 16, 1991

[86] PCT No.: PCT/EP91/02413

§ 371 Date: Sep. 3, 1993

§ 102(e) Date: Sep. 3, 1993

[87] PCT Pub. No.: WO92/16729

PCT Pub. Date: Oct. 1, 1992

[30] Foreign Application Priority Data

Mar. 16, 1991 [GB] United Kingdom ..... 9105602
Jun. 14, 1991 [GB] United Kingdom ..... 9112916

[51] Int. Cl.[6] ..... F02B 75/02

[52] U.S. Cl. ..... 123/302; 123/432

[58] Field of Search ..... 123/21, 302, 481, 123/198 F, 432

[56] References Cited

U.S. PATENT DOCUMENTS 4,237,832 12/1980 Hartig et al. ..... 123/64
4,392,459 7/1983 Chareire ..... 123/21
4,688,532 8/1987 Hasegawa ..... 123/302
4,781,154 11/1988 Tanahashi et al. ..... 123/302
4,834,048 5/1989 Adamis et al. ..... 123/432
5,005,539 4/1991 Kawamura ..... 123/21
5,038,739 8/1991 Ishii ..... 123/198 F
5,056,486 10/1991 Johannes ..... 123/432
5,063,899 11/1991 Hitomi et al. ..... 123/339
5,069,175 12/1991 Simko ..... 123/432
5,259,344 11/1993 Huang et al. ..... 123/481

*Primary Examiner*—David A. Okonsky
*Attorney, Agent, or Firm*—Rogers, Howell & Haferkamp, L.C.

[57] ABSTRACT

A four stroke engine cylinder head (16) has two inlet pipes (19 and 22) which contain alternate acting inlet valves (14 and 15). Fuel/air induction strokes through valve (14) alternate with air only induction strokes through valve (15) giving an eight stroke cycle under half load. When gate valve (23) is moved by a control to the dotted position, this seals the air only inlet and opens port (25) to give fuel/air induction strokes over half load and a four stroke cycle. Air only induction strokes or eight stroke cycles under half load may also be achieved by cutting out some fuel injectors or injection strokes as the load permits.

9 Claims, 2 Drawing Sheets

PISTON ENGINE CYCLES

TECHNICAL FIELD

Figure 1:
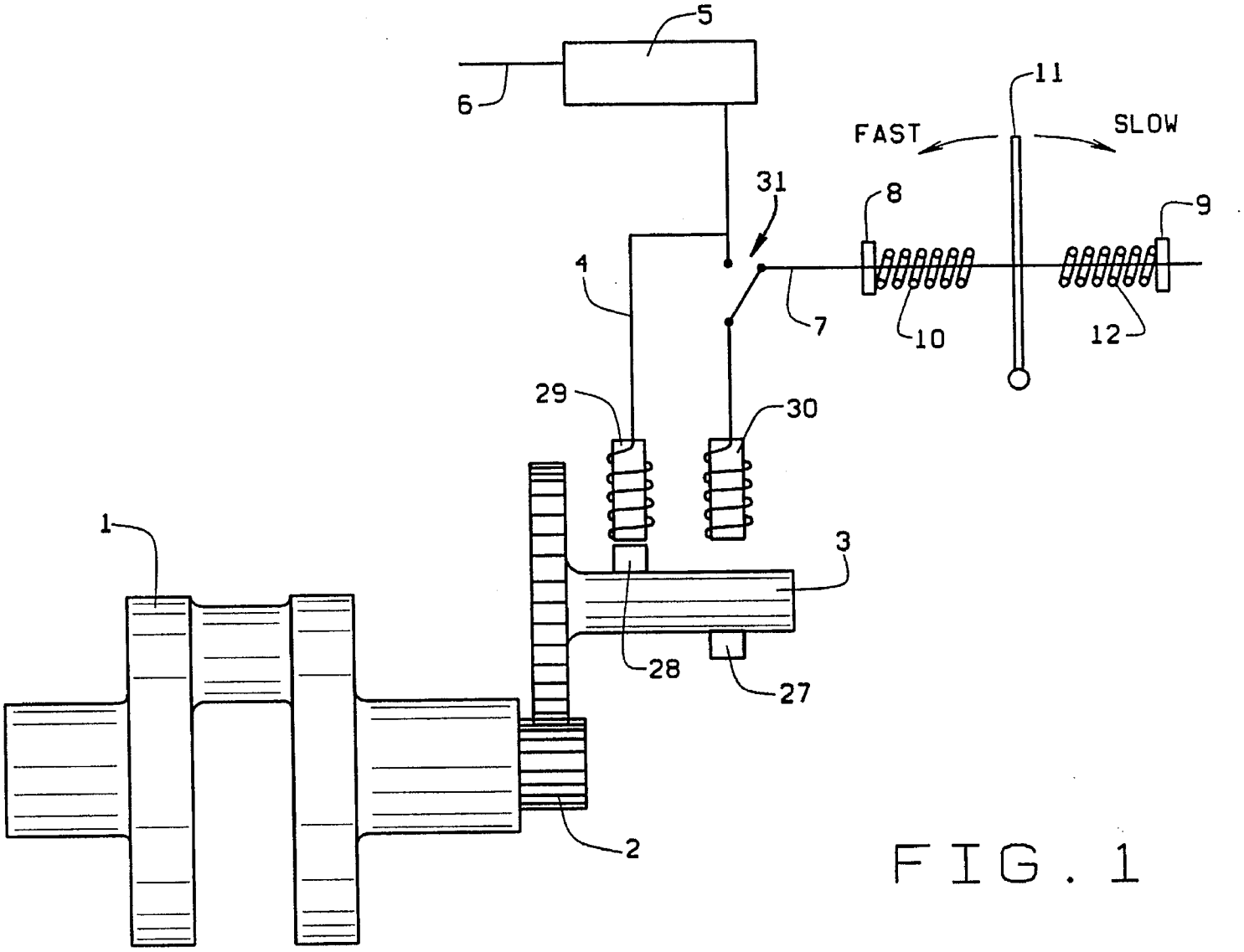
Figure 2:
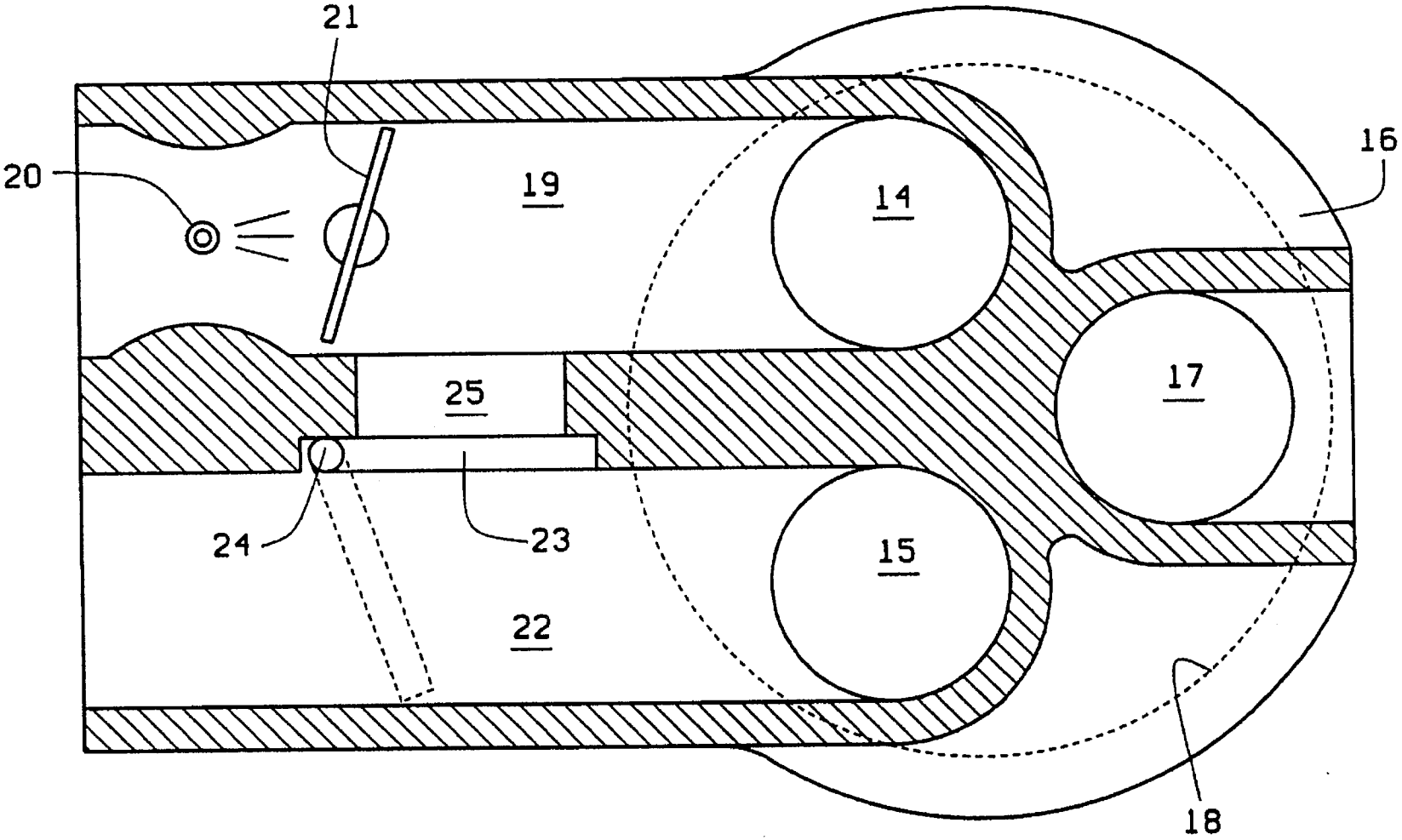

This invention concerns additional piston engine cycles or strokes.

BACKGROUND ART

In piston engines, particularly 4 stroke petrol engines, their efficiency is reduced when the engine load is reduced. At the end of the exhaust stroke a residue of exhaust gas is left in the cylinder. This exhaust residue is hot and causes the temperature of the incoming fuel/air mixture to be increased. A high temperature of the mixed gases at the start of the compression stroke reduces the fuel efficiency of the engine. Conversely, a reduction in the temperature of the gases at the start of compression would increase the efficiency.

The efficiency of a piston engine is also increased when the speed of combustion is increased.

Also the efficiency of a piston engine is increased when the temperature rise during combustion is increased.

Furthermore the efficiency of a piston engine is increased when the combustion pressure or the effective compression ratio is increased.

This invention aims to increase fuel efficiency in all the above respects which may lead to reduced exhaust emissions.

DISCLOSURE OF INVENTION

There is a piston engine where additional, air only, induction strokes are introduced, when the load demanded of the engine is less than full load, causing the remaining power strokes to be more fuel efficient.

When the load is reduced to less than 50%, a 4 stroke engine can change to an 8 stroke cycle. This may be achieved by preventing the induction of fuel on alternate induction strokes.

Thus after a normal cycle of induction, compression, power and exhaust the next stroke is an induction stroke of air only with no fuel. The following power stroke produces no power because there was no fuel to ignite. On the next induction stroke a larger quantity of air and fuel is induced, giving twice the power of a conventional power stroke on a normal 4 stroke engine, as it runs producing less than half its maximum load.

My earlier patent application G.B.9105602.8 stated that: In the case of a single cylinder petrol engine with fuel injection, the injection system is of the type where injection is triggered to occur at a specific point in the cycle, usually during the induction stroke. Two separate trigger devices are used to cause fuel to be injected on alternate cycles. A shaft may be driven at ¼ crankshaft speed. Mounted on this shaft are two magnets, namely magnet 27 and magnet 28. Two coils register with the magnets. Coil 29 registers only with magnet 28 and coil 30 registers only with magnet 27.

The magnets and coils are arranged so that magnet 28 passes coil 29 inducing a current to cause fuel to be injected into the engine during the induction stroke on cycle 1. On the next cycle, cycle 2, magnet 27 triggers coil 30 to cause a similar fuel injection. On the third cycle 29 followed by 30 etc.

Wires connect coil 29 and coil 30 to the fuel injection metering device so that a signal from 29 or 30 will trigger the injection of fuel. A switch 31 is fitted in the wire from coil 30 to the metering device. Switch 31 is operated directly or indirectly by the throttle or accelerator position. When the accelerator pedal demands more than 50% engine load, switch 31 is closed providing normal fuel injection on each 4 stroke cycle. When the accelerator pedal demands less than 50% engine load, Switch 31 is open, causing fuel to be injected on alternate cycles, i.e. an 8 stroke cycle.

Multi-cylinder engines may be provided with separate, alternate acting coils as 29 & 30 for each cylinder. In practice, however, electronic circuits can correctly time and sequence the desired fuel injection described above from one or more engine speed related events, such as an impulse in the ignition circuit. Engines with an odd number of cylinders only provide regular cycles in both 4 stroke and 8 stroke modes.

The triggering and sensing devices and the controls can be electrical, mechanical, magnetic, hydraulic or any other means, to provide the alternate air only induction or 8 stroke cycle. In place of the alternate sequence any other sequence can be used with advantage if the load permits. For example 1 power stroke followed by 2 cycles with no power, i.e. 100100100100 etc. Otherwise a sequence as follows: 110110110110 or any other regular or irregular sequence.

Likewise, 2 stroke engines can also benefit from air only induction strokes, causing the remaining working strokes to be more fuel efficient. On a 2 stroke engine the shaft triggering injection may run at half engine speed. Injection of fuel may be directly into the 4 stroke or 2 stroke engine cylinder, the inlet port or the transfer port of a 2 stroke engine.

BRIEF DESCRIPTION OF DRAWING 1/2

A 4 stroke engine has a crankshaft 1, to which gear 2 is attached. Driven by gear 2 is shaft 3 at ¼ crankshaft speed. Attached to shaft 3 are two magnets, magnet 27 and magnet 28. Registering with magnet 27 is coil or sensor 30. Opposite magnet 28 is coil or sensor 29. Wire 4 connects coil 29 to fuel injection metering device 5 and wire 6 leads on to the fuel injector (not shown). The wire from coil 30 leads to a switch 31 which is operated by rod 7. Attached to rod 7 are two collars 8 and 9. Between collars 8 and 9 are spring 10, accelerator pedal or throttle lever 11 and spring 12.

In operation, as the accelerator pedal 11 moves to fast, switch 31 closes so that coil 30 triggers fuel injection on alternate induction strokes. Coil 29 also provides a signal to inject fuel on the remaining induction strokes so the engine works normally on a 4 stroke cycle. As the accelerator 11 moves to slow, switch 31 opens so that no signal reaches the metering device from coil 30. Only coil 29 is then connected to metering device 5 to cause fuel to be injected on alternate cycles, thereby causing the engine to work on an 8 stroke cycle.

BEST MODE FOR CARRYING OUT THE INVENTION WITH REFERENCE TO DRAWING 2/2

My later GB patent application no. 9112916.3 further stated that, in the case of engines with carburettors or more simple fuel injection, that:

In a preferred embodiment, by way of example only, fuel/air induction strokes can alternate with air only induction strokes, by using two or more inlet valves for each cylinder as follows. In the case of a single cylinder 4 stroke petrol engine, on cycle 1 inlet valve 14 is opened by a cam driven at ¼ crankshaft speed. There can then be an induction of fuel/air from the carburettor or fuel injector through the inlet pipe to inlet valve 14 in the usual way. During the induction of fuel/air through inlet valve 14, inlet valve 15 remains closed. The usual strokes follow induction, namely compression, power and exhaust. On the next induction stroke, however, inlet valve 14 remains closed and inlet valve 15 is opened by the camshaft. There is no fuel injector or carburettor supplying fuel to valve 15, so this induction stroke is an induction of air only, with no fuel. The following power stroke produces no power because there was no fuel to ignite. The 8 stroke cycle then repeats itself with air only induction strokes alternating with fuel/air induction strokes, as the engine continues to run at less than half its maximum load.

When more power is required a gate valve or a series of valves can close the air only inlet to valve 15 and open a port so that the carburettor or fuel injector supplying valve 14 now also supplies valve 15. Fuel/air can then be supplied via valve 14 on cycle 1, valve 15 on cycle 2, followed by valve 14 on cycle 3 etc., so that each induction stroke is an induction of fuel/air for maximum power and a normal 4 stroke cycle.

A gate valve can control the engine cycles. A 4 stroke cycle results when fuel/air enter through each valve and an 8 stroke cycle results when fuel/air enter through one valve with air only entering through the other valve. The position of the gate valve is controlled directly or indirectly by the throttle or accelerator position.

Drawing 2/2 shows inlet valves 14 and 15 in cylinder head 16, which also contains exhaust valve(s) 17. Valves 14, 15 and 17 are opened by a camshaft (not shown) which may be driven at ¼ crankshaft speed. The cylinder wall 18 is shown dotted. Inlet pipe 19 supplies fuel/air from carburettor jet or fuel injector 20, regulated by throttle valve 21. Inlet pipe 22, supplies air only to inlet valve 15, when the engine is running at less than 50% load in 8 stroke mode. However, when more than 50% load is required, gate valve 23 moves about hinge 24 to the dotted position. In the dotted position, the gate valve closes the air only inlet to valve 15 and opens port 25, to allow fuel/air mixture in inlet pipe 19 to enter inlet port 22 and engine cylinder 18, via inlet valve 15, thus providing fuel/air induction on all induction strokes and a 4 stroke cycle.

Gate valve 23 is operated directly or indirectly by the throttle or accelerator pedal position (not shown) so that when less than 50% load is required, Gate valve 23 closes port 25, providing air only induction through valve 15 and fuel/air induction through valve 14 for an 8 stroke cycle.

As an alternative to the fuel injector being in position 20, fuel injectors can be positioned in each inlet pipe, or close to each inlet valve seat, so that either injector can be turned off to provide air only inductions. The injectors may also be turned off or on for any particular induction stroke, to give an 8 stroke cycle, or any other regular or irregular sequence to provide an advantageous number of air only induction strokes between the working fuel/air inductions strokes.

INDUSTRIAL APPLICABILITY

This Invention may have a considerable impact on the automotive manufacturing industry and those concerned with air quality and exhaust emissions.

My own practical application has shown the equivalent of increased miles per gallon ranging from 60% more miles at the lightest loads to 23% more miles at half load in 8 stroke mode compared with the same engine at the same speeds and loads in 4 stroke mode. The total mass of emissions may be reduced in the same proportion.

I claim:

1. An internal combustion engine comprising:

at least one cylinder having a piston mounted therein for reciprocating strokes of the piston in the cylinder, the reciprocating strokes including induction strokes of the piston in the cylinder where at least air is drawn into the cylinder;

a first intake channel communicating with the cylinder;

a second intake channel communicating with the cylinder;

an exhaust channel communicating with the cylinder;

a first intake valve in the first intake channel controlling communication between the first intake channel and the cylinder;

a second intake valve in the second intake channel controlling communication between the second intake channel and the cylinder;

means for supplying fuel to at least the first intake channel; and means for controlling opening of at least one of the first and second intake valves on each induction stroke of the piston in the cylinder to cause an air and fuel mixture to be drawn into the cylinder when only the first intake valve is opened on an induction stroke and to cause only air to be drawn into the cylinder when only the second intake valve is opened on an induction stroke.

2. The internal combustion engine of claim 1, wherein:

the engine is a four-cycle engine and the reciprocating strokes of the piston in the cylinder include a recurring series of four strokes including the induction stroke, a compression stroke, one of a power stroke, and an expansion stroke, and an exhaust stroke.

3. The internal combustion engine of claim 1, wherein:

the means for supplying fuel to the first intake channel is a fuel injector.

4. The internal combustion engine of claim 1, wherein:

the means for supplying fuel to the first intake channel is a carburetor.

5. The internal combustion engine of claim 2, wherein:

the means for controlling opening of at least one of the first and second intake valves controls opening of only the second intake valve on an induction stroke between successive openings of only the first intake valve on induction strokes when the engine is operated at less than half of its average available load.

6. The internal combustion engine of claim 2, wherein:

the means for controlling opening of at least one of the first and second intake valves controls respective openings of the first and second intake valves on successive induction strokes when the engine is operated at more than half of its average available load.

7. The internal combustion engine of claim 1, wherein:

means are provided between the first and second intake channels for alternately providing cross communication between the first and second intake channels while closing the second intake channel and blocking cross communication between the first and second intake channels while opening the second intake channel.

8. The internal combustion engine of claim 7, wherein:

the means for alternately providing and blocking cross communication between the first and second intake channels includes a gate valve positioned between the first and second intake channels and means for opening the gate valve when the engine is operated at more than half of its average available load and for closing the gate valve when the engine is operated at less than half of its available load.

9. The internal combustion engine of claim 1, wherein:

the engine has an odd number of cylinders.

* * * * *